US006558132B2

(12) United States Patent
Hanggi

(10) Patent No.: US 6,558,132 B2
(45) Date of Patent: May 6, 2003

(54) VARIABLE DISPLACEMENT PUMP

(75) Inventor: Roger Hanggi, Ann Arbor, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/960,906

(22) Filed: Sep. 24, 2001

(65) Prior Publication Data

US 2003/0059313 A1 Mar. 27, 2003

(51) Int. Cl.[7] ..... F04B 49/035

(52) U.S. Cl. ..... 417/220; 417/213; 418/30; 418/31

(58) Field of Search ..... 417/220, 213; 418/30, 31

(56) References Cited

U.S. PATENT DOCUMENTS 2,878,756 A * 3/1959 O'Connor et al. ..... 417/220
4,531,893 A * 7/1985 Okoh et al. ..... 417/220
4,558,998 A * 12/1985 Kiyoshige et al. ..... 418/26
5,178,525 A * 1/1993 Murota ..... 418/26
6,042,343 A * 3/2000 Semba et al. ..... 417/220
6,352,415 B1 * 3/2002 Uchino ..... 417/220

* cited by examiner

*Primary Examiner*—Charles G. Freay
*Assistant Examiner*—Emmanuel Sayoc
(74) *Attorney, Agent, or Firm*—Leslie C. Hodges

(57) ABSTRACT

A variable displacement vane pump comprises a pump body having inlet and outlet ports, a rotor driven by a drive shaft and co-axially aligned therewith, a plurality of radially extending vanes slidably disposed in the rotor, and a slide pivotally disposed on a pivot in the pump body and having a central axis eccentric to the axis of the rotor. A plurality of fluid chambers are defined by the rotor, vanes, and slide. A spring acts on the slide to urge the slide in one direction. A regulating chamber is configured as a semi-circular cylinder intermediate the pump body and an outer surface of the slide, wherein a pressure regulating valve pressurizes the regulating chamber to pivot the slide against the force of the spring to decrease the volume of the fluid chambers. The slide includes a slide channel formed in a face to channel fluid leakage from the fluid chambers away from the regulating chamber.

10 Claims, 4 Drawing Sheets

VARIABLE DISPLACEMENT PUMP

TECHNICAL FIELD

The present invention relates to variable displacement pumps for use in automatic transmissions.

BACKGROUND OF THE INVENTION

A hydraulic system for a transmission pressurizes and distributes transmission fluid to the operating devices and to the lubrication and cooling circuits. A variable displacement vane type pump is often selected for the transmission pump. It employs a rotor and a slide with multiple vanes to vary the volume of fluid delivered to the hydraulic circuits. The slide is eccentrically offset from the rotor to create fluid chambers defined by the vanes, rotor, and inner surface of the slide. A compression spring positions the slide to create large fluid chambers as the default. When the transmission requires less volume of fluid by the pump, a pressure regulator directs fluid from the pump output line to a regulating chamber in the pump. Pressure in the regulating chamber pivots the slide against the force of the spring to more closely align the centers of the rotor and slide, thereby reducing the size of the fluid chambers. This reduces the amount of fluid drawn into the pump from the fluid reservoir and likewise, the amount of fluid output by the pump.

With variable displacement vane type pumps, it is desirable to minimize leakage from various sources into the regulating chamber as this is a root cause of line pressure instability. If excess fluid accumulates in the regulating chamber, then the pump outputs less fluid than is required by the transmission. For example, oil may leak from the fluid chambers, between the slide and an adjacent cover or housing, to the regulating chamber. Leaking to the regulating chamber may be reduced, but not eliminated, by higher performing seals and by tighter manufacturing tolerances to reduce clearances.

There are two ways to control pump output. The first and preferred way is to direct line pressure to the regulating chamber via the pressure regulator to decrease pump output. The second way is to remove pressure from the regulating chamber via the pressure regulator by exhausting fluid to increase pump output. It is believed that the pump operates in this mode due to excess fluid leaking to the regulating chamber. This second mode may result in shudder during shifts and an undesirable shift feel for customers.

A variable displacement vane type pump having features to minimize fluid leakage to the regulating chamber is needed.

SUMMARY OF THE INVENTION

The present invention is for a variable displacement vane type pump, which comprises a pump body having inlet and outlet ports, a rotor driven by a drive shaft and co-axially aligned therewith, a plurality of radially extending vanes slidably disposed in the rotor, and a slide pivotally disposed on a pivot in the pump body and having a central axis eccentric to the axis of the rotor. A plurality of fluid chambers are defined by the rotor, vanes, and slide which transfer fluid from the inlet to the outlet port. To vary the size of the fluid chambers, a regulating chamber is pressurized by a pressure regulator to pivot the slide against the force of a spring. The regulating chamber is configured as a semi-circular cylinder intermediate the pump body and an outer surface of the slide.

Leakage to the regulating chamber tends to create line pressure instability, which has a direct influence on clutch apply and torque transfer affecting shift quality. Therefore to isolate the regulating chamber from leakage thereto, a slide channel is formed in a face of the slide to channel fluid leakage from the fluid chambers away from the regulating chamber. The slide channel diverts any leakage from the pump fluid chambers to a non-regulating chamber through a port in the slide. A slide channel may be included on one or both sides of the slide.

Where the pump and pressure regulator are incorporated in the pump body, high pressure routings in the body may leak fluid to the regulating chamber. To divert such fluid before it reaches the regulating chamber, a housing exhaust channel may be formed in the pump body.

DESCRIPTION OF THE PREFERRED EMBODIMENT

Figure 1:
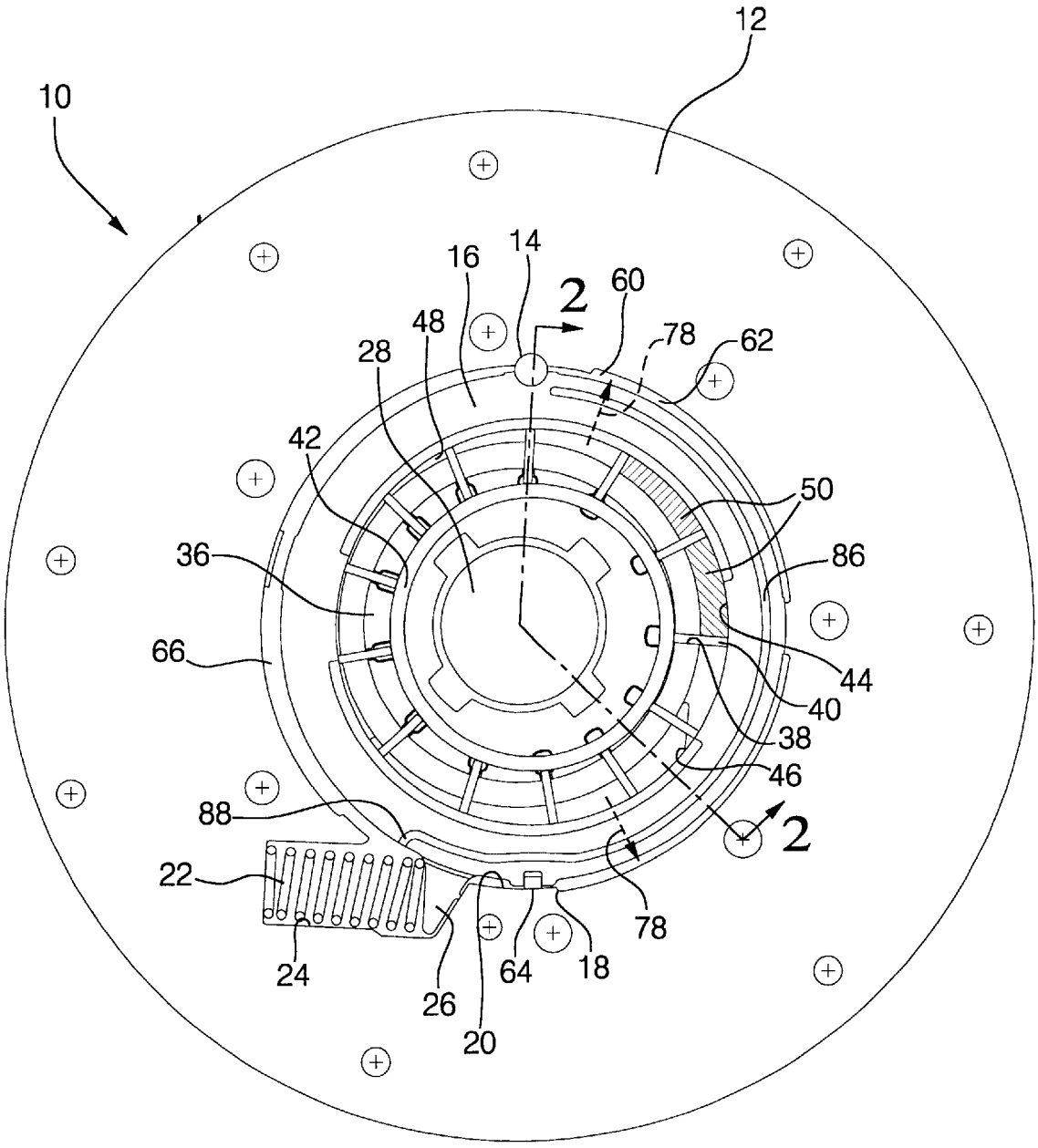
FIG. 1 is an elevational view of a pump incorporating the present invention with the pump cover removed.

The present invention provides a variable displacement vane type pump for distributing transmission fluid to a transmission hydraulic circuit. The pump, generally designated as 10 and illustrated in FIGS. 1 and 2, includes a pump body 12 in which is secured a pivot pin 14. A ring member, referred to as a slide 16, is pivotally mounted on the pin 14 and slidably supported at 18 on a surface 20 formed in the body 12. The slide 16 is urged to the position shown by a compression spring 22, which is disposed in a cylindrical opening 24 formed in the body 12 and abuts a lug 26 formed on the slide 16.

A pump drive shaft 28 is rotatably mounted in the body 12 through a needle bearing 30, and has a splined end 32 drivingly connected to a spline 34 formed on a pump rotor 36. The pump rotor 36 has a plurality of radial slots 38 formed therein and in each of the slots is slidably disposed a vane member 40. The vanes 40 are urged radially outwardly by a pair of vane control rings 42 and centrifugal force toward an inner cylindrical surface 44 of the slide 16.

The pump body 12 has formed therein a pair of kidney shaped ports, an inlet port 46 and an outlet port 48 for the pump 10. A plurality of fluid chambers 50 are formed by the rotor 36, vanes 40, and inner surface 44 of the slide 16 and are successively connected to the inlet and outlet ports 46,48. The chambers 50 rotate with the rotor 36 and expand and contract during rotation due to an eccentric offset between the slide 16 and rotor as is well-known in vane-type pumps. The chambers 50 expand in the area of the inlet port 46, which accepts fluid from a reservoir, not shown, and passes the fluid to the chambers, and contract in the area of the outlet port 48 to discharge fluid therethrough.

Figure 5:
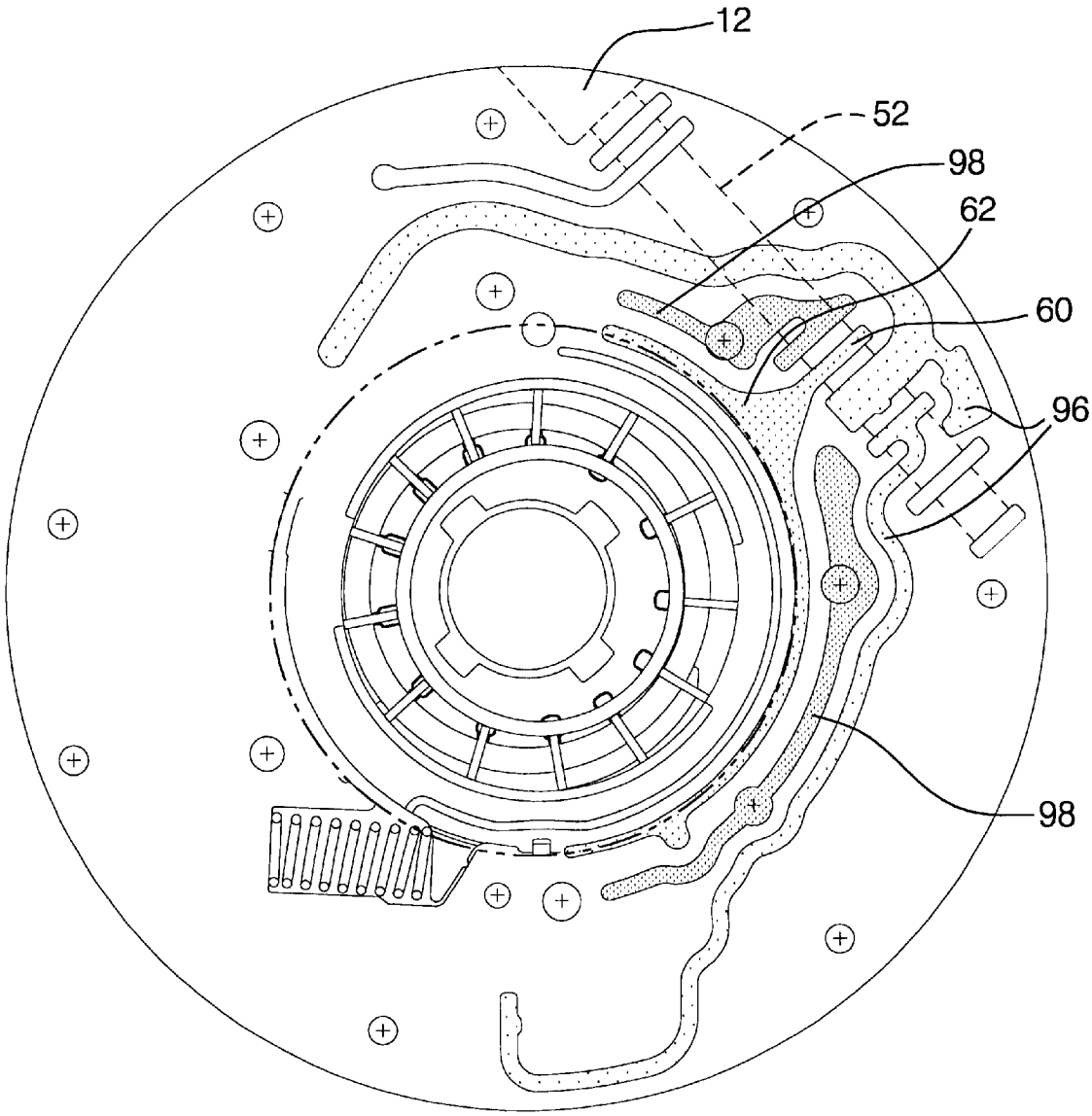
FIG. 5 is a view of the pump body.

A pressure regulator 52, FIG. 5, regulates the line pressure delivered from the outlet port 48 of the pump 10 to the hydraulic circuits. If pump delivery exceeds demand, the size of the fluid chambers 50 are decreased by positioning the slide 16 to more closely align the slide's center with the rotor's center. This is achieved as the pressure regulator 52 directs line pressure fluid through a regulating port 60 in the pump body 12 and into a regulating chamber 62. The regulating chamber 62 extends between the outer circumference of the slide 16 and the inner surface 20 of the pump body 12, and from the pivot pin 14 to a seal member 64, defining an essentially semi-cylindrical chamber. The spring 22 acts in opposition to the pressure in the regulating chamber 62 such that as the pressure in the regulating chamber rises, the slide 16 compresses the spring as it rotates about the pivot pin 14. The positions of the slide and pressure regulator valve constantly change depending on vehicle operation and the amount of fluid pressure and volume needed to operate the transmission. A non-regulating chamber 66 is disposed between the outer circumference of the slide 16 and the inner surface 20 of the pump body, on the side opposing the regulating chamber 62.

Figure 2:
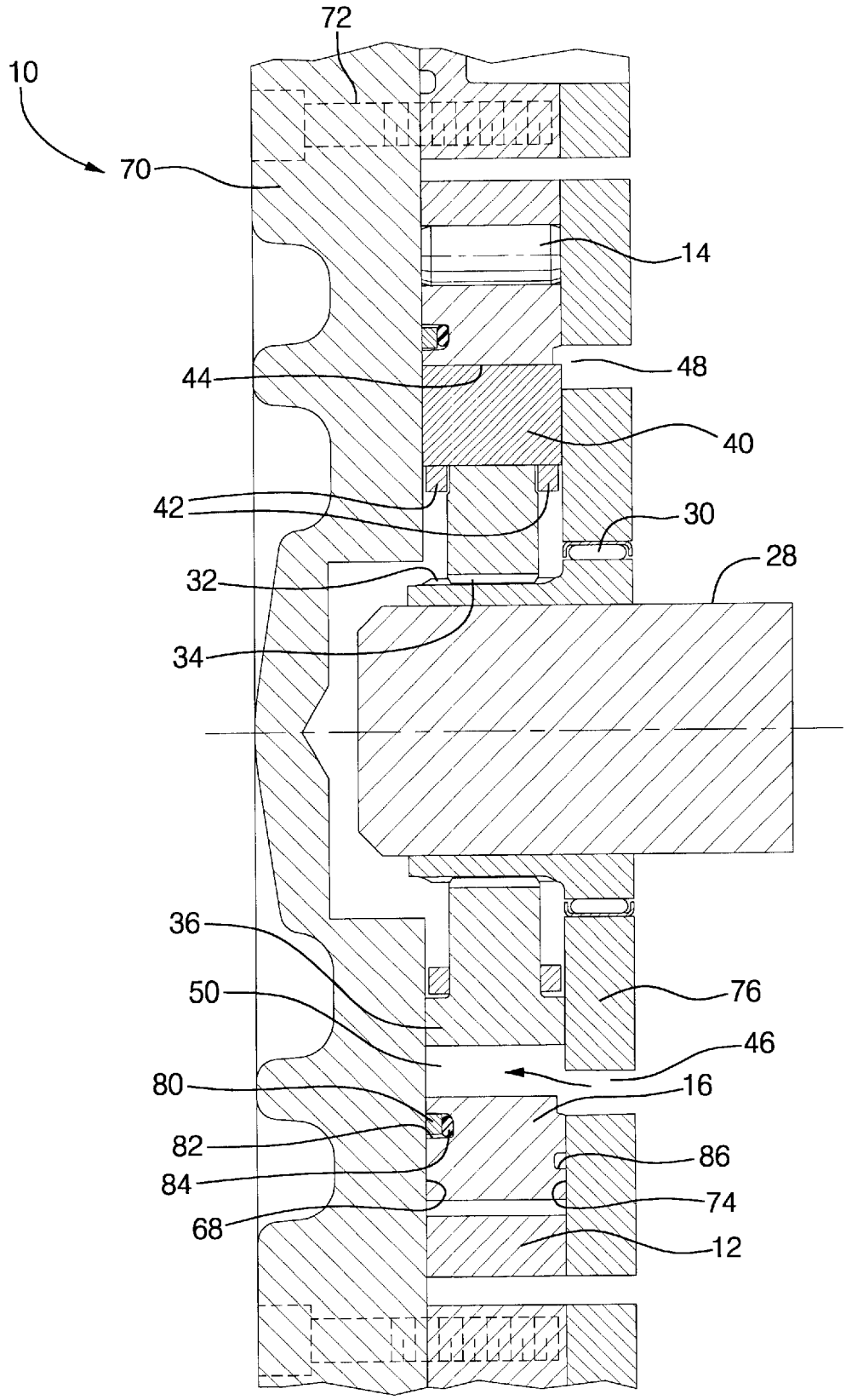
FIG. 2 is a sectional view taken along line 2—2 in FIG. 1.

As illustrated in FIG. 2, the left face 68 of the slide 16, rotor 36, and fluid chambers 50 are closed by a first housing or cover 70, which is secured to the body 12 by a plurality of fasteners 72, and the right face 74 is covered by a second housing 76. Alternatively the pump body 12 and either housing 70,76 could be integrated as a single housing.

A fluid leak path 78, in FIG. 1, exists from the fluid chambers 50 to the regulating chamber 62 due to the clearance between the slide 16 and the first and second housings 70, 76. Further there is a pressure differential therebetween, since the line pressure generated in the fluid chambers is greater than the regulating chamber pressure. It is desirable to minimize and effectively eliminate leakage of fluid into the regulating chamber 62 as this affects the control of the pump output. Leakage from the chambers 50 radially outwardly may be reduced, but not eliminated, by a seal ring 80 disposed in a seal groove 82 formed in the slide 16 and urged toward the cover by a resilient backing ring 84.

Figure 3:
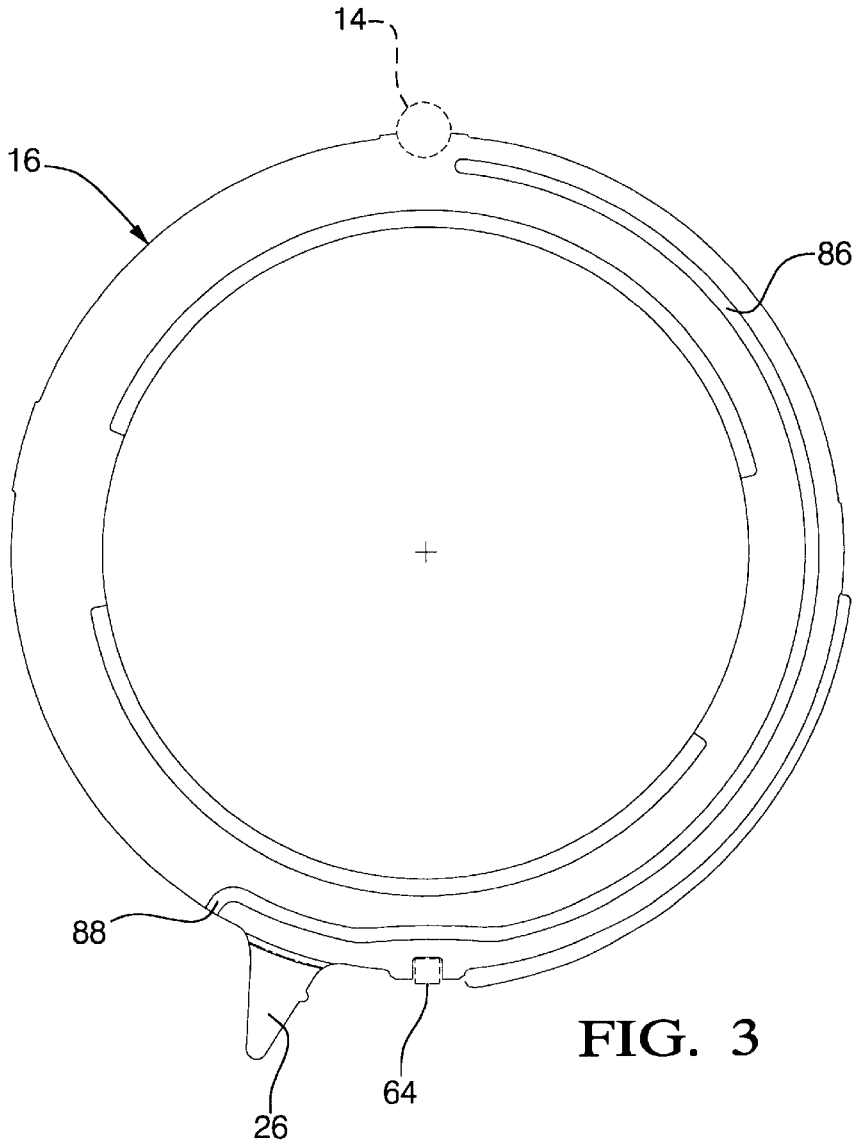
FIG. 3 is a view of the pump slide.

The present invention provides a means of interrupting the fluid leak path 78 by introducing a region, having lower pressure than the regulating chamber 62, which is intermediate of the fluid chambers 50 and the regulating chamber. This is accomplished by a slide channel 86 formed into one or both faces 68,74 of the slide 16, radially intermediate the fluid chambers 50 and the regulating chamber 62, to channel leaked oil from the leak path 78 before it reaches the regulating chamber. The slide channel 86 extends circumferentially about the slide 16 over the same or greater angle span as the semi-circular regulating chamber 62. The regulating chamber 62 extends from the slide pivot pin 14 to the seal 64, and the slide channel 86 extends from the pivot pin, beyond the seal and the slide lug 26, to an exhaust port 88 in the non-regulating pump chamber 66, as shown in FIG. 3. Therefore the fluid leak path 78 to the regulating chamber 62 is completely interrupted by the slide channel 86, as the slide channel 86 intersects any radius which includes the regulating chamber and the fluid chamber 50. Any fluid in the non-regulating chamber 66 may be returned to the fluid reservoir or routed to the fluid chambers 50 near the inlet port 46. The pressure in the non-regulating chamber 66, and therefore the slide channel 86, is effectively zero, which is the same as or lower than the regulating chamber 62. Therefore fluid leaking out of the high pressure fluid chambers 50 flow into the low (or zero) pressure slide channel 86 and not into the regulating chamber 62.

Figure 4:
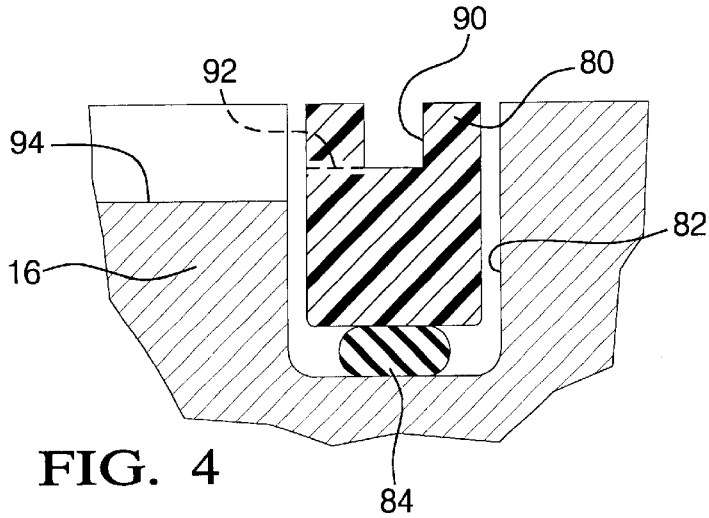
FIG. 4 is sectional schematic of the present invention embodied in a seal.

As an alternative to including a channel in the slide, a channel 90 may be incorporated in the seal ring 80 as shown in FIG. 4. The channel 90 may be a full circle or be a circumferential groove about the same or greater angle span as the regulating chamber 62. A notch 92 in the seal ring 80 connects the channel 90 with the non-regulating pump chamber 66. In this case, an additional linking channel 94 in the slide 16 is added in order to link the seal notch 92 with the non-regulating pump chamber 66.

Oil may also leak to the regulating chamber 62 from high pressure routings 96 in the body 12, downstream of the pressure regulator 52, as shown in FIG. 5. This source of oil leakage may be addressed by including one or more housing exhaust channels 98 in the pump body 12 to divert any leakage to the exhaust side of the pressure regulator 52. The housing exhaust channel 98 is disposed radially intermediate the high pressure routings 96 and the regulating chamber 62. The housing channel 98 extends circumferentially about the body 12 over the same or greater angle span as the semi-circular regulating chamber 62. Therefore the leak path to the regulating chamber 62 is interrupted by the housing channel 98, as the channel intersects any radius which includes the regulating chamber 62 and the high pressure routings 96. The channel 98 is in communication with the exhaust side of the pressure regulator 52 to channel fluid leakage away from the regulating chamber.

Therefore the pump may include both a slide channel to divert leakage away from the inner circumference of the regulating chamber, and a housing channel to divert leakage away from the outer circumference of the regulating chamber.

The foregoing description of the preferred embodiment of the invention has been presented for the purpose of illustration and description. It is not intended to be exhaustive, nor is it intended to limit the invention to the precise form disclosed. It will be apparent to those skilled in the art that the disclosed embodiment may be modified in light of the above teachings. The embodiment was chosen to provide an illustration of the principles of the invention and its practical application to thereby enable one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

What is claimed is:

1. A variable displacement vane pump, comprising:

a pump body;

inlet and outlet ports formed in said pump body;

a drive shaft rotatably mounted in said pump body;

a rotor driven by said drive shaft and co-axially aligned therewith;

a plurality of radially extending vanes slidably disposed in said rotor;

a pivot disposed in said pump body;

a slide pivotally disposed on said pivot in said pump body and having a central axis eccentric to the axis of said rotor;

a plurality of fluid chambers defined by said rotor, said vanes, and said slide that are successively connected to said inlet and outlet ports;

a spring acting on said slide to urge said slide in one direction;

a regulating chamber configured as a semi-circular cylinder intermediate said pump body and an outer surface of said slide, a pressure regulating valve for pressurizing said regulating chamber to pivot said slide against the force of said spring to decrease the volume of said fluid chambers; and a slide channel formed in a face of said slide to channel fluid leakage from said fluid chambers away from said regulating chamber, wherein said slide channel is at substantially atmospheric pressure.

2. A variable displacement vane pump, comprising:

a pump body;

inlet and outlet ports formed in said pump body;

a drive shaft rotatably mounted in said pump body;

a rotor driven by said drive shaft and co-axially aligned therewith;

a plurality of radially extending vanes slidably disposed in said rotor;

a pivot disposed in said pump body;

a slide pivotally disposed on said pivot in said pump body and having a central axis eccentric to the axis of said rotor;

a plurality of fluid chambers defined by said rotor, said vanes, and said slide that are successively connected to said inlet and outlet ports;

a spring acting on said slide to urge said slide in one direction;

a regulating chamber configured as a semi-circular cylinder intermediate said pump body and an outer surface of said slide;

a pressure regulating valve for pressurizing said regulating chamber to pivot said slide against the force of said spring to decrease the volume of said fluid chambers; and a slide channel formed in a face of said slide to channel fluid leakage from said fluid chambers away from said regulating chamber, wherein said slide channel is radially intermediate said fluid chambers an said regulating chamber, extends circumferentially about said slide, and has an angle span as great as said regulating chamber thereby interrupting any leakage flow from said fluid chambers to said regulating chamber.

3. A variable displacement vane pump, as defined in claim 2, further comprises a second slide channel formed in an opposing face of said slide.

4. A variable displacement vane pump, as defined in claim 2, further comprises a non-regulating chamber configured as a semi-circular cylinder intermediate said pump body and said outer surface of said slide, opposing said regulating chamber, said slide channel extends from said pivot pin to said non-regulating chamber and includes an exhaust port communicating said slide channel and said non-regulating pump chamber.

5. A variable displacement vane pump, comprising:

a pump body;

inlet and outlet ports formed in said pump body;

a drive shaft rotatably mounted in said pump body;

a rotor driven by said drive shaft and co-axially aligned therewith;

a plurality of radially extending vanes slidably disposed in said rotor;

a pivot disposed in said pump body;

a slide pivotally disposed on said pivot in said pump body and having a central axis eccentric to the axis of said rotor;

a plurality of fluid chambers defined by said rotor, said vanes, and said slide that are successively connected to said inlet and outlet ports;

a spring acting on said slide to urge said slide in one direction;

a regulating chamber configured as a semi-circular cylinder intermediate said pump body and an outer surface of said slide;

a pressure regulating valve for pressurizing said regulating chamber to pivot said slide against the force of said spring to decrease the volume of said fluid chambers;

a seal ring disposed in a seal groove formed in a face of said slide intermediate said fluid chamber and said regulating chamber, said seal ring having a channel formed in an exterior side to channel fluid leakage from said fluid chambers away from said regulating chamber.

6. A variable displacement vane pump, as defined in claim 5, wherein said channel has an angle span as great as said regulating chamber.

7. A variable displacement vane pump, as defined in claim 6, further comprises a non-regulating chamber configured as a semi-circular cylinder intermediate said pump body and said outer surface of said slide, opposing said regulating chamber, said channel extends from said pivot pin to said non-regulating chamber and includes an exhaust port communicating said channel and said non-regulating pump chamber.

8. A variable displacement vane pump, comprising:

a pump body;

inlet and outlet ports formed in said pump body;

a drive shaft rotatably mounted in said pump body;

a rotor driven by said drive shaft and co-axially aligned therewith;

a plurality of radially extending vanes slidably disposed in said rotor;

a pivot disposed in said pump body;

a slide pivotally disposed on said pivot in said pump body and having a central axis eccentric to the axis of said rotor;

a plurality of fluid chambers defined by said rotor, said vanes, and said slide that are successively connected to said inlet and outlet ports;

a spring acting on said slide to urge said slide in one direction;

a regulating chamber configured as a semi-circular cylinder intermediate said pump body and an outer surface of said slide;

a pressure regulating valve for pressurizing said regulating chamber to pivot said slide against the force of said spring to decrease the volume of said fluid chambers;

high pressure routings in said pump body downstream of said pressure regulating valve;

a housing exhaust channel in said pump body radially intermediate said high pressure routings and said regulating chamber to channel fluid leakage from said high pressure routings away from said regulating chamber.

9. A variable displacement vane pump, as defined in claim 8, wherein said housing exhaust channel has an angle span as great as said regulating chamber.

10. A variable displacement vane pump, as defined in claim 9, wherein said housing exhaust channel communicates with an exhaust side of said pressure regulating valve.

* * * * *